US007336291B2

(12) United States Patent
Lee

(10) Patent No.: US 7,336,291 B2
(45) Date of Patent: Feb. 26, 2008

(54) THERMAL IMAGE FORMING APPARATUS

(75) Inventor: Yong-duk Lee, Gunpo-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 227 days.

(21) Appl. No.: 11/225,103

(22) Filed: Sep. 14, 2005

(65) Prior Publication Data

US 2006/0061649 A1 Mar. 23, 2006

(30) Foreign Application Priority Data

Sep. 20, 2004 (KR) ..... 10-2004-0075064

(51) Int. Cl.
*B41J 2/325* (2006.01)

(52) U.S. Cl. ..... 347/215

(58) Field of Classification Search ..... 347/197, 347/218, 219, 171, 172, 174, 175, 176, 177, 347/104; 400/188
See application file for complete search history.

(56) References Cited

U.S. PATENT DOCUMENTS

| | | | | |
|---|---|---|---|---|
| 3,709,432 | A | 1/1973 | Robertson | 239/4 |
| 4,190,844 | A | 2/1980 | Taylor | 347/82 |
| 4,642,659 | A * | 2/1987 | Nagashima et al. | 347/219 |
| 4,914,522 | A | 4/1990 | Duffield et al. | 358/296 |
| 5,963,235 | A | 10/1999 | Chwalek et al. | 347/82 |
| 6,079,821 | A | 6/2000 | Chwalek et al. | 347/82 |
| 6,296,405 | B1 * | 10/2001 | Brewington et al. | 400/188 |
| 6,447,182 | B2 * | 9/2002 | Brewington et al. | 400/188 |
| 6,474,795 | B1 | 11/2002 | Lebens et al. | 347/82 |
| 6,505,921 | B2 | 1/2003 | Chwalek et al. | 347/77 |
| 6,508,542 | B2 | 1/2003 | Sharma et al. | 347/77 |
| 6,509,917 | B1 | 1/2003 | Chwalek et al. | 347/82 |
| 6,601,952 | B2 * | 8/2003 | Sugioka et al. | 347/104 |

FOREIGN PATENT DOCUMENTS

| | | |
|---|---|---|
| JP | 59-20688 | 2/1984 |
| JP | 7-137393 | 5/1995 |
| JP | 7-290784 | 11/1995 |
| JP | 9-58034 | 3/1997 |
| JP | 9-226161 | 9/1997 |
| JP | 10-217516 | 8/1998 |
| JP | 2004-18217 | 1/2004 |

* cited by examiner

*Primary Examiner*—K. Feggins
(74) *Attorney, Agent, or Firm*—Staas & Halsey LLP

(57) ABSTRACT

A thermal image forming apparatus to form an image on a recording medium having first and second sides, the apparatus including a recording head to form the image by heating the recording medium, wherein the recording head rotates between first and second locations to respectively face the first and second sides of the recording medium; and a rotation guide to rotate along with the recording head to guide the recording medium to the recording head.

22 Claims, 9 Drawing Sheets

THERMAL IMAGE FORMING APPARATUS

CROSS-REFERENCE TO RELATED APPLICATIONS

This application claims the benefit of Korean Patent Application No. 10-2004-0075064, filed on Sep. 20, 2004, in the Korean Intellectual Property Office, the disclosure of which is incorporated herein by reference.

BACKGROUND OF THE INVENTION

1. Field of the Invention

The present invention relates to an image forming apparatus, and, more particularly, to a thermal image forming apparatus capable of forming an image on both sides of a recording medium.

2. Description of the Related Art

In order to print an image on both sides of a recording medium, two recording heads may be provided at positions respectively facing both sides of the recording medium. In this case, however, such an image forming apparatus becomes expensive to produce. As one alternative method to create the double-sided print, one recording head is provided and the recording head is designed to face the first and second sides of the recording medium in turn. In this case, two approaches may be considered. A first approach is to fix the recording head and invert the recording medium. A second approach is to move the recording head to the respective positions facing the first and second sides of the recording medium.

SUMMARY OF THE INVENTION

The present invention provides a thermal image forming apparatus having one recording head, in which a double-sided printing can be achieved by alternately moving the recording head to first and second positions facing first and second sides of a recording medium.

Additional aspects and/or advantages of the invention will be set forth in part in the description which follows and, in part, will be apparent from the description, or may be learned by practice of the invention.

According to an aspect of the present invention, there is provided a thermal image forming apparatus including: a support member to support a recording medium, the recording medium having first and second sides opposite to each other; a recording head, facing the support member, to form an image by heating the recording medium, wherein the recording head is rotatable around a shaft of the support member such that the recording head moves to first and second locations respectively facing the first and second sides of the recording medium; a conveying part to convey the recording medium; and a rotation guide to rotate together with the recording head such that the recording medium is guided between the support member and the recording head.

The rotation guide may include a first guide part positioned between the support member and the conveying part in response to the recording head being positioned at the first location, such that the recording medium is guided between the support member and the recording head; and a second guide part positioned between the support member and the conveying part in response to the recording head being positioned at the second location, such that the recording medium is guided between the support member and the recording head.

The thermal image forming apparatus may further include a pair of support brackets rotatably supported around a shaft of the support member, and coupled to the recording head and the rotation guide; and a motor rotating at least one of the support brackets.

The thermal image forming apparatus may further include a pair of support brackets rotatably supported around a shaft of the support member, and coupled to the recording head and the rotation guide; a shaft having a first end coupled to the recording head and a second end inserted into a through hole formed in at least one of the support brackets; a motor; and a rotation cam rotated by the motor, wherein the rotation cam moves the shaft coupled to the recording head to rotate the pair of support brackets.

According to another aspect of the present invention, there is provided a thermal image forming apparatus including: a recording head to form an image by heating a recording medium, the recording medium having first and second sides opposite to each other; a support member, facing the recording head, to support the recording medium to form a printing nip; a conveying part to convey the recording medium; a pair of support brackets rotatably supported around a shaft of the support member, and coupled to the recording head; a motor to rotate the support bracket such that the recording head is moved to first and second locations respectively facing the first and second sides of the recording medium; and a rotation guide coupled to the support brackets to guide the recording medium to the printing nip.

According to another aspect of the present invention, there is provided a thermal image forming apparatus to form an image on a recording medium having first and second sides, the apparatus comprising a recording head to form the image by heating the recording medium, wherein the recording head rotates between first and second locations to respectively face the first and second sides of the recording medium; and a rotation guide to rotate along with the recording head to guide the recording medium to the recording head.

The apparatus may further comprise a support member to support the recording medium, wherein the recording head and rotation guide rotate around the support member between the first and second locations.

The rotation guide may comprise a first guide part to guide the recording medium to the recording head in the first location, and a second guide part to guide the recording medium to the recording head in the second location.

The apparatus may further comprise an elastic member coupled to the recording head and the rotation guide to elastically bias the recording head in a direction to cause contact with the support member.

The apparatus may further comprise at least one support bracket coupled to the recording head and rotation guide, wherein the support bracket rotates to move the recording head and rotation guide between the first and second locations.

The apparatus may further comprise a locking member to lock the support bracket in each of the first and second locations.

The support bracket may comprise at least one locking portion provided to interact with the locking member to lock the support bracket in each of the first and second locations.

The locking portion may be a receiving portion to receive a protrusion provided on the locking member.

The apparatus may further comprise a biasing member to bias the locking member in a direction toward the support bracket.

The apparatus may further comprise a rotation cam to rotate and move the locking member out of a position in which the support bracket is locked.

The recording medium may reciprocate twice through a substantially straight path to the recording head to form the image on each of the first and second sides of the recording medium.

According to another aspect of the present invention, there is provided a thermal image forming apparatus to form images on a recording medium having first and second sides, the apparatus comprising a supporting member to support the recording medium; a recording head to rotate around the supporting member to form the respective images on the first and second sides of the recording medium; and a rotation guide coupled so as to rotate along with the recording head to guide the recording medium between the supporting member and recording head; wherein the recording medium reciprocates twice between the recording head and the supporting member without being inverted.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1A:
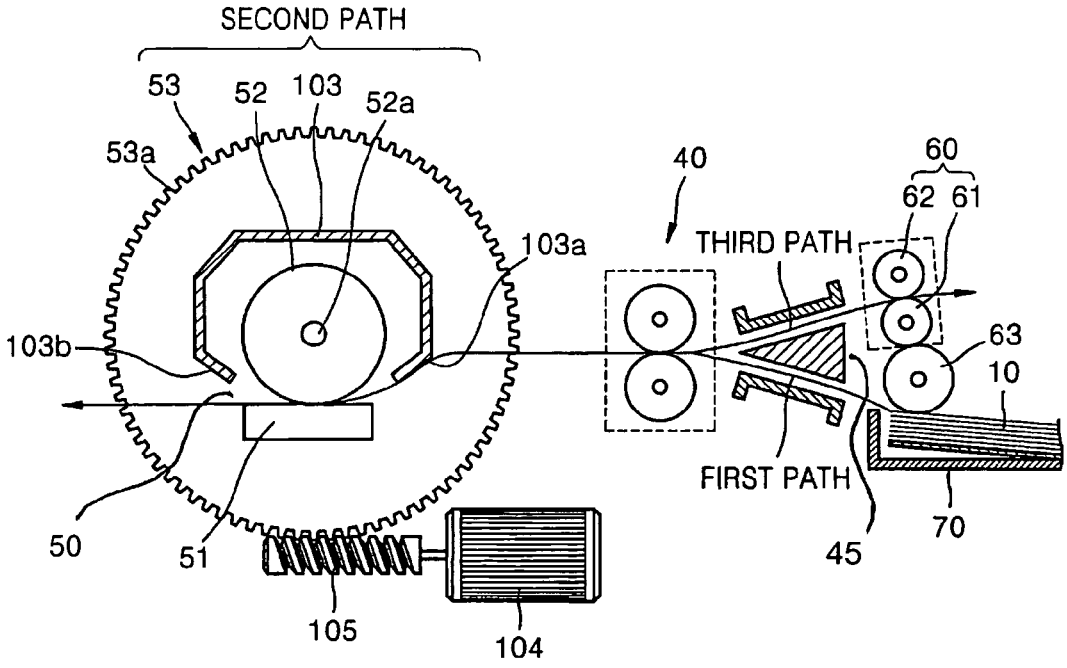
FIGS. 1A and 1B illustrate a thermal image forming apparatus according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 1B:
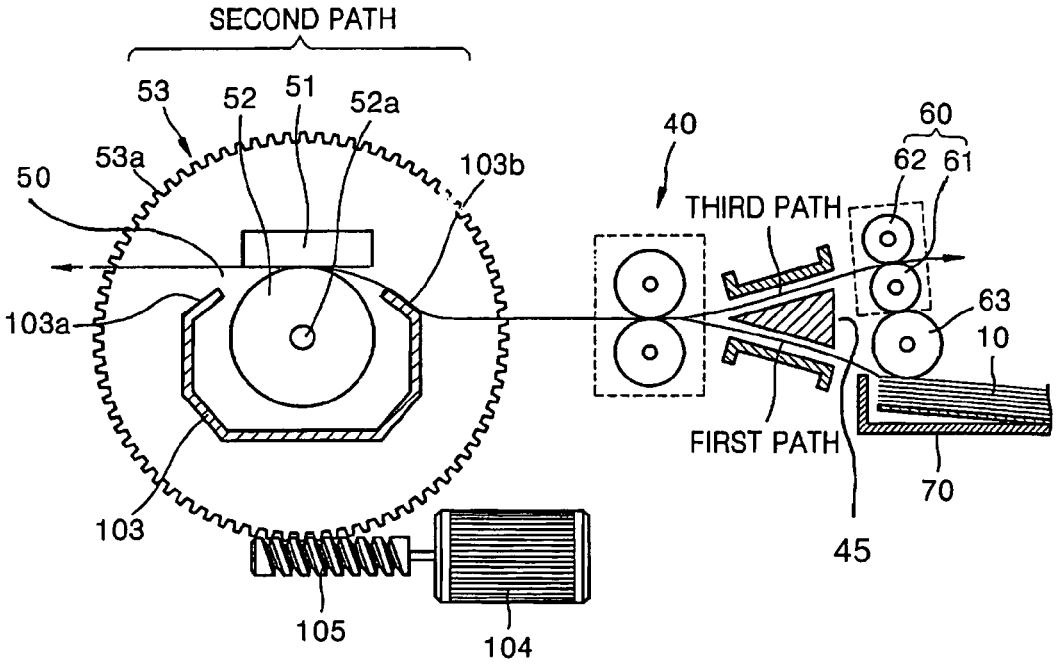

FIGS. 1A and 1B illustrate an image forming apparatus according to an embodiment of the present invention. Referring to FIGS. 1A and 1B, an image forming apparatus has a first path, a second path, and a third path, through which a recording medium 10 is conveyed. The first path is a feed path through which the recording medium 10 is conveyed toward the second path. The second path is a path through which a printing is performed on the recording medium 10. The third path is a path through which the recording medium 10 is temporarily discharged during the printing, or completely discharged after an image is completely printed on first and second sides of the recording medium.

A recording medium guide 45 is disposed between the first path and the third path. The recording medium guide 45 guides the recording medium fed through the first path toward the second path, and also guides the recording medium 10 from the second path to the third path during the printing. A conveying part 40 conveys the recording medium 10 from the first path to the second path, from the second path to the third path, from the third path to the second path, and again from the second path to the third path, in this order.

Figure 6:
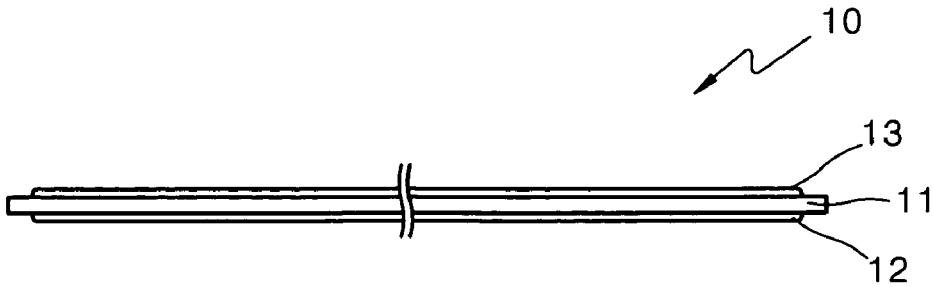
FIG. 6 illustrates a sectional view of a recording medium according to an embodiment of the present invention.

The recording medium 10 used in the image forming apparatus may have a structure such as illustrated in FIG. 6. The recording medium 10 includes a base sheet 11 having first and second sides, and color ink layers 12 and 13 formed on the first and second sides. Each of the ink layers 12 and 13 may respectively have a single-layer structure for single color, or a multi-layer structure for two or more colors. For example, the ink layer 12 formed on the first side may be provided with two stacked layers for yellow and magenta, and the ink layer 13 formed on the second side may be provided with a single layer for cyan.

The image forming apparatus according to this embodiment of the present invention may use the recording medium 10 which produces color images provided by the image formation with respect to the first and second sides, or the recording medium 10 which can provide a double-sided printing. The technical scope of the present invention is not limited to the above-described ink stacked structures formed on the first and second sides of the recording medium 10. The present invention provides a thermal image forming apparatus having a recording head 51 which includes a thermal print head (TPH).

An image forming part 50, including the recording head 51 and a support member 52, is disposed on the second path. The support member 52 faces the recording head 51 and supports the recording medium 10, thereby forming a printing nip. As shown in FIGS. 1A and 1B, a platen roller may be used as the support member 52. In this embodiment, the recording head 51 rotates around a shaft 52*a* of the support member 52 and moves to the first and second locations that respectively face the first and second sides of the recording medium 10. For this purpose, the image forming apparatus includes a pair of support brackets 53 that are supported rotatably around the shaft 52*a* of the support member 52. The recording head 51 is coupled to the pair of support brackets 53. A gear 53*a* is provided at an outer periphery of one of the pair of support brackets 53. A motor 104 includes a worm gear 105 engaged with the gear 53*a*. The image forming apparatus further includes a rotation guide 103. When the recording head 51 is positioned at the first and second locations, the recording medium 10 conveyed to the second path by the conveying part 40 is guided between the recording head 51 and the support member 52 by the rotation guide 103. The rotation guide 103 is coupled to the pair of the support brackets 53, and is rotated together with the recording head 51. The rotation guide 103 has first and second guide parts 103*a* and 103*b*. As shown in FIG. 1A, when the recording head 51 is positioned at the first location, the first guide part 103*a* faces the conveying part 40 and guides the recording medium 10 between the recording head 51 and the support member 52. As shown in FIG. 1B, when the recording head 51 is positioned at the second location, the second guide part 103*b* faces the conveying part 40 and guides the recording medium 10 between the recording head 51 and the support member 52. The first and second guide parts 103*a* and 103*b* have shapes suitable for guiding the recording medium 10 between the recording head 51 and the support member 52. In this embodiment, the shapes of the first and second guide parts 103*a* and 103*b* are symmetrical with each other with respect to the center of the support member 52. However, the present invention is not limited to this described embodiment. That is, the shapes of the guide parts can be asymmetrical with each other. The first and second guide parts 103*a* and 103*b* may have shapes suitable for guiding the recording medium 10 between the recording head 51 and the support member 52 in consideration of the arrangement of the support member 52 and the conveying part 40, and in consideration of the difference in positions when the recording head 51 is positioned at the first and second locations.

The movement of the recording head 51 and the rotation guide 103 is executed when the recording medium 10 is not positioned at the second path, for example, before the recording medium 10 is fed from the first path, or when the recording medium 10 is conveyed to the third path after the printing on the first side but does not return to the second path.

A discharge part 60, including a discharge roller 61 and an idle roller 62 engaged therewith, is provided on the third path so as to discharge the recording medium 10. In this embodiment, a pick-up roller 63 and the discharge roller 61 are in contact with each other and are driven by one drive motor (not shown).

The recording medium 10 is picked up from a cassette 70 by the pick-up roller 63, and is fed from the first path to the second path by the conveying part 40. The recording medium 10 is guided between the recording head 51 and the support member 52 by the first guide part 103*a*. As shown in FIG. 1A, the recording head 51 is positioned at the first location so that it faces the first side of the recording medium 10. When the recording medium 10 is positioned at a print start location, the conveying part 40 conveys the recording medium 10 from the second path to the third path. During that time, the recording head 51 heats the first side of the recording medium 10, thereby printing the image thereon. After finishing the printing on the first side, the motor 104 rotates the pair of support brackets 53 such that the recording head 51 is moved to the second location facing the second side of the recording medium 10, as shown in FIG. 1B. The rotation guide 103 is rotated together with the recording head 51 such that the second guide part 103*b* faces the conveying part 40. The recording medium 10 conveyed by the conveying part 40 is guided from the third path to the second path by the second guide part 103*b*. When the recording medium 10 is positioned at the print start location, the conveying part 40 again conveys the recording medium 10 from the second path to the third path. During that time, the printing on the second side of the recording medium 10 is performed. After finishing the printing on the second side of the recording medium 10, the recording medium 10 is discharged out of the image forming apparatus by the discharge part 60.

The base sheet 11 of the recording medium 10 may be formed of a transparent material. An opaque layer may be formed on one ink layer, such as, for example, the ink layer 12. Seen from the ink layer 13, cyan, magenta and yellow images are overlapped with one another, thereby representing full color images. The thermal image forming apparatus according to this embodiment of the present invention can be used for a double-sided printing, that is, an image forming on both the first and second sides of the recording medium. If the base sheet 11 is formed of an opaque material, the double-sided printing is possible by forming different images on the first and second sides.

In order to form an image on both sides of the recording medium 10, the recording head 51 rotates around the shaft 52*a* of the support member 52. Also, the recording medium 10 reciprocates two times through a straight path. Since the recording medium 10 is conveyed through a very simple path while an image is formed on both sides thereof, the probability that the recording medium 10 will be jammed is very low. Also, since the rotation guide 103 rotates together with the recording head 51, the recording medium 10 can be stably guided to the printing nip between the recording head 51 and the support member 52 even when the position of the printing nip is changed.

Figure 2:
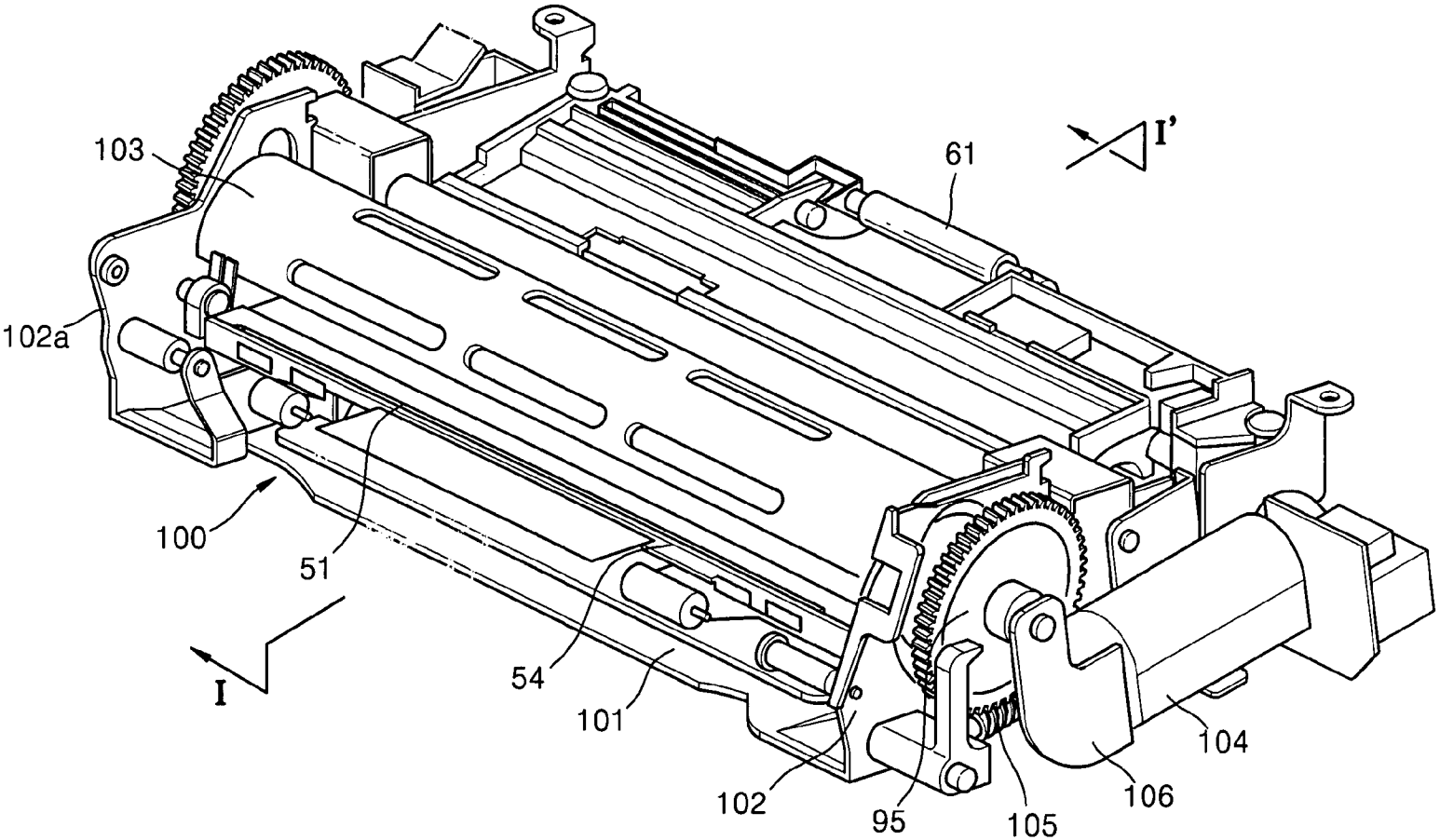
FIG. 2 illustrate a perspective view of a thermal image forming apparatus according to another embodiment of the present invention.
Figure 3A:
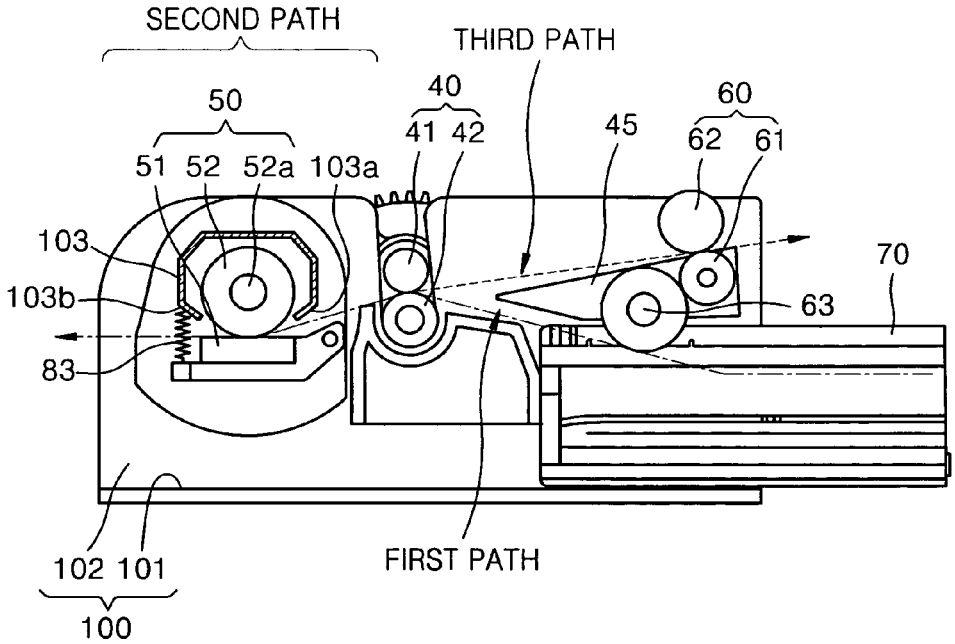
FIGS. 3A and 3B illustrate sectional views taken along line I-I' of FIG. 2.
Figure 3B:
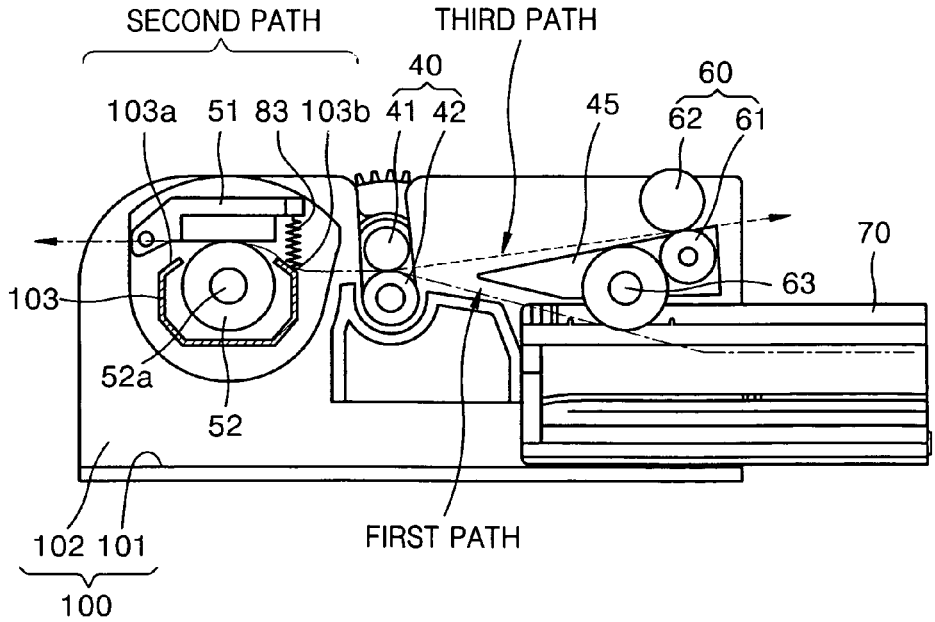
Figure 4:
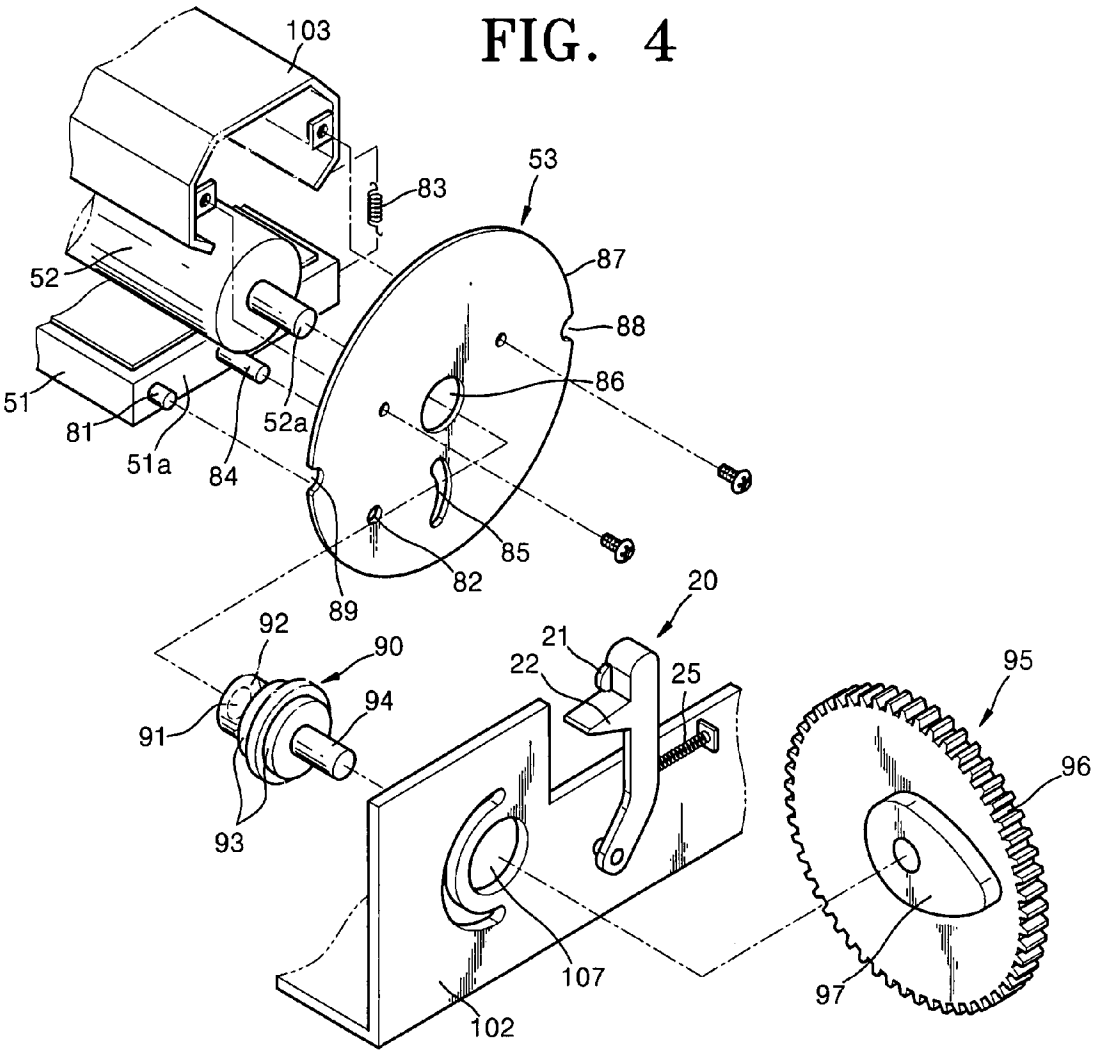
FIG. 4 is an exploded perspective view illustrating a rotation structure of a recording head of FIG. 2.

FIG. 2 illustrates a perspective view of a thermal image forming apparatus according to another embodiment of the present invention, FIGS. 3A and 3B illustrate sectional views taken along line I-I' of FIG. 2, and FIG. 4 illustrates an exploded perspective view of a rotating structure of the recording head of FIG. 2.

Referring to FIGS. 2, 3A and 3B, a frame 100 includes a lower base 101 and two side plates 102 and 102*a* respectively disposed upright on both sides of the lower base 101. The cassette 70 into which the recording medium 10 may be loaded is mounted on one side of the frame 100. The pick-up roller 63 to pick up the recording medium 10 from the cassette 70 may be provided at an upper side of the cassette 70. The discharge part 60 to discharge the printed recording medium may be provided at an upper side of the pick-up roller 63. The discharge part 60 includes the discharge roller 61 and the idle roller 62 engaged therewith. In this embodiment, the pick-up roller 63 and the discharge roller 61 are in contact with each other, and are driven by one drive motor (not shown). The drive motor (not shown) may be coupled to the side plate 102*a*. The recording head 51 and the support member 52 may be provided at a side opposite to the discharge part 60 between the two side plates 102 and 102*a*. The conveying part 40 conveys the recording medium 10. The conveying part 40 includes a pair of rollers 41 and 42, which are elastically engaged with each other. A torque of the drive motor is transferred to only one of the rollers 41 and 42, and the other roller is driven.

As shown in FIG. 1, the above-described structure defines the first path from the cassette 70 to the conveying part 40, the second path from the conveying part 40 to the image forming part 50, and the third path from the conveying part 40 to the discharge part 60. The recording medium guide 45 separates the first path from the third path. The rotation guide 103 rotates together with the recording head 51. In this embodiment, the rotation guide 103 encloses the support member 52. The rotation guide 103 has first and second guide parts 103*a* and 103*b*. As shown in FIG. 3A, when the recording head 51 is positioned at the first location, the first guide part 103*a* is positioned between the conveying part 40 and the support member 52, and guides the recording medium 10. As shown in FIG. 3B, when the recording head 51 is positioned at the second location, the second guide part 103*b* is positioned between the conveying part 40 and the support member 52, and guides the recording medium 10.

In this embodiment, the recording head 51 rotates around the shaft 52*a* of the support member 52. For this purpose, the recording head 51 and the support member 52 are coupled to the pair of support brackets 53. Also, the rotation guide 103 rotates together with recording head 51.

Referring to FIG. 4, a hinge shaft 81 is provided at a side portion 51*a* of the recording head 51 and a hinge hole 82 is formed at the pair of support brackets 53. The hinge shaft 81 is inserted into the hinge hole 82 such that the recording head 51 is rotatable around the hinge hole 82 of the pair of support brackets 53. The rotation guide 103 is coupled to the pair of to the support brackets 53. An elastic member 83 elastically biases the recording head 51 in a direction which comes into contact with the support member 52. As shown in FIG. 4, a tension coil spring having one end coupled to the recording head 51, and the other end coupled to the rotation guide 103 enclosing the support member 52, can be used as the elastic member 83.

One end of a shaft 84 is coupled to the recording head 51, and the other end is inserted into a through hole 85 formed at the support bracket 53. The through hole 85 may be formed in a long opening shape so as to allow the recording head 51 to move in a direction to come into contact with the support member 52, or in a direction to be separated from the support member 52. Also, the through hole 85 may be formed in an arc shape centering on the hinge hole 82, because the recording head 51 comes into contact with the support member 52 and is separated from the support member 52 by its rotation around the hinge hole 82. In this embodiment, the support member 52 is not directly coupled to the drive motor (not shown). As the recording medium 10 is fed by the conveying part 40, the support member 52 comes into contact with the recording medium 10 such that it is driven and rotated. Of course, the support member 52 may also be directly connected to the drive motor (not shown).

A bushing 90 includes an inner circumference portion 91, and first to third outer circumference portions 92, 93 and 94, which are concentric. The shaft 52*a* of the support member 52 is inserted into the inner circumference portion 91. The first outer circumference portion 92 is rotatably inserted into a support hole 86 formed at the support bracket 53. A rotation cam 95 is rotatably coupled to the third outer circumference portion 94. The rotation cam 95 includes a gear 96 and a cam 97 which comes into contact with the shaft 84. A motor (104 in FIG. 2) includes a worm gear 105 engaged with the gear 96. The motor 104 is coupled to a bracket 106, and the bracket 106 is coupled to the side plate 102. The second outer circumference portion 93 of the bushing 90 is inserted into a hole 107 formed at the side plate 102, and an end portion of the third outer circumference portion 94 is supported by the bracket 106. The bracket 106 prevents the rotation cam 95 from being released from the third outer circumference portion 94. Due to this structure, the support member 52, the pair of support brackets 53, and the rotation cam 95 can be configured to be concentric. The support bracket 53 has a circular outer circumference 87, and first and second locking grooves 88 and 89 are formed on the outer circumference 87 at an angel of approximately 180° therebetween. A locking member 20 is rotatably coupled to the side plate 102. An elastic member 25 applies an elastic force to the locking member 20 in a direction coupling to the first and second locking grooves 88 and 89. In this embodiment, the locking member 20 is unlocked from the first and second locking grooves 88 and 89 by the rotation cam 95, and is locked thereto by the elastic force of the elastic member 25. The locking member 20 has a protrusion 21 to be coupled to the first and second locking grooves 88 and 89, and an interference portion 22 contacting the cam 97 of the rotation cam 95. Although not illustrated in the drawings, another one of the pair of support brackets 53 is rotatably coupled on the side plate 102*a* such that it is rotatable around the shaft 52*a* of the support member 52.

FIGS. 5A through 5I are sectional views illustrating a rotating operation of the recording head. The operation of the thermal image forming apparatus according to this embodiment of the present invention will now be described with reference to FIGS. 1 through 4 and FIGS. 5A through 5I.

Figure 5A:
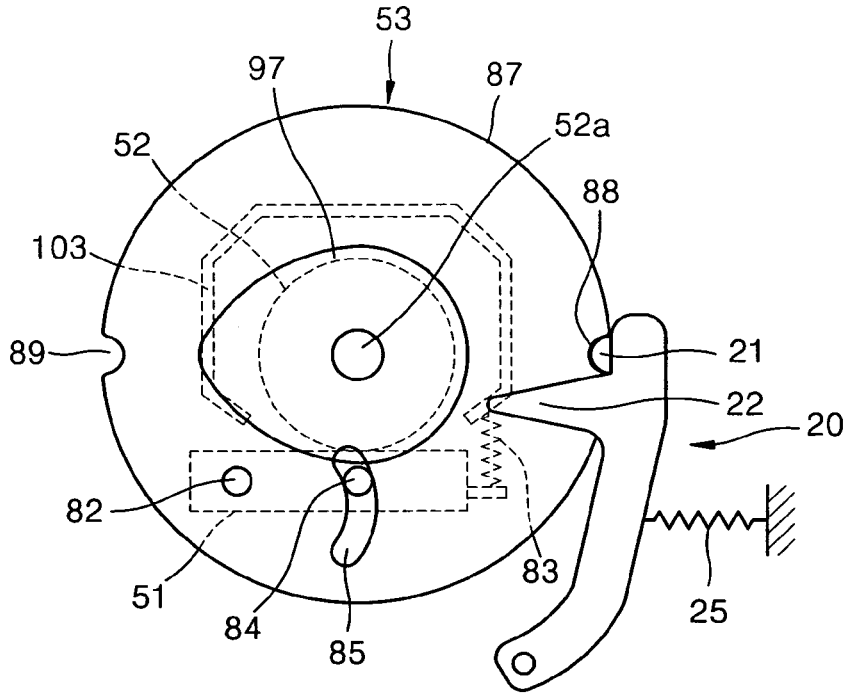
FIGS. 5A through 5I are views illustrating a rotating operation of a recording head.

Referring to FIG. 5A, the recording head 51 is elastically brought into contact with the support member 52. Also, the protrusion 21 of the locking member 20 is caught by the first locking groove 88, such that the recording head 51 is locked to the first location. The recording medium 10, fed from the feed cassette 70 by the pick-up roller 63, is conveyed to the conveying part 40 through the first path. Before the recording medium 10 is conveyed to the second path, or before the recording medium 10 is picked up by the pick-up roller 63, it is preferable, though not necessary, that the recording head 51 be separated apart from the support member 52.

Figure 5B:
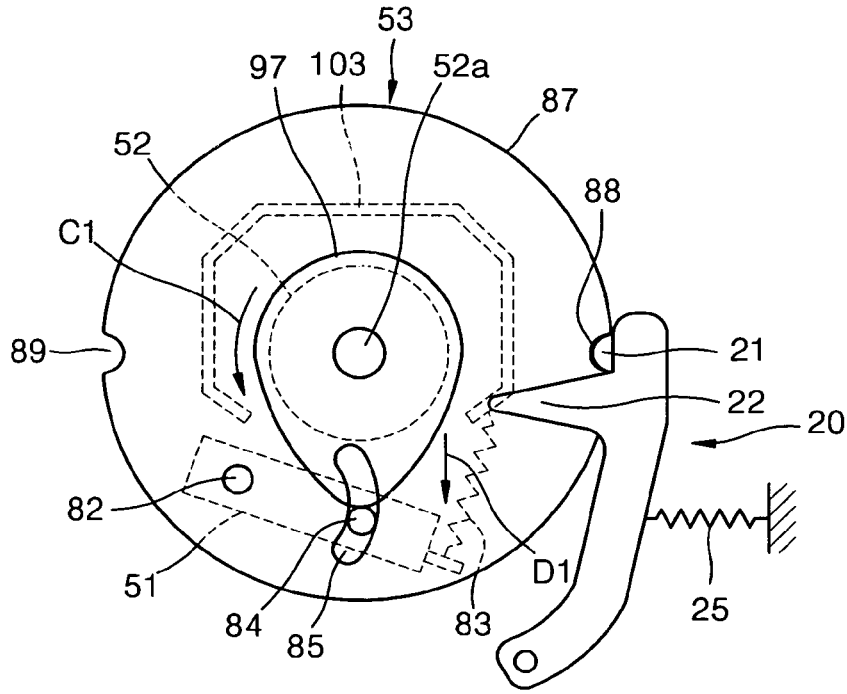

Referring to FIG. 5B, the rotation cam 95 rotates in a direction indicated by an arrow "C1" and the cam 97 pushes the shaft 84. The support bracket 53 does not rotate because the protrusion 21 of the locking member 20 is locked to the first locking groove 88. As the shaft 84 is pushed along the through hole 85 in a direction indicated by an arrow "D1", the recording head 51 rotates around the hinge hole 82, such that the recording head 51 is separated from the support member 52. In this state, the conveying part 40 conveys the recording medium 10 toward the second path. As shown in FIG. 3A, the recording medium 10 conveyed by the conveying part 40 is guided between the recording head 51 and the support member 52 by the first guide part 103*a*. Since the recording head 51 is separated from the support member 52, the recording medium 10 enters between the recording head 51 and the support member 52 without any resistance even when the platen roller 52 does not rotate.

Figure 5C:
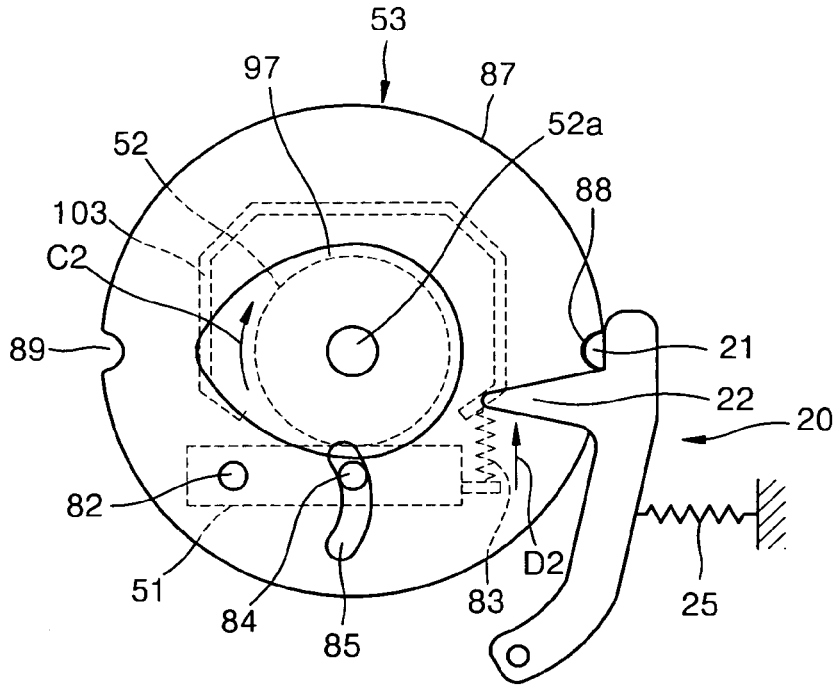

When the recording medium 10 is conveyed up to a predetermined print start location, the conveying part 40 stops conveying the recording medium 10. Although not shown, a sensor may be provided to detect a front end and/or a rear end of the recording medium 10 so as to detect the print start location. Since it is apparent to those skilled in the art that the sensor to detect the print start location can be appropriately configured, a detailed description thereof will be omitted. Referring to FIG. 5C, the rotation cam 95 rotates in a direction indicated by an arrow C2. Since the protrusion 21 of the locking member 20 is coupled to the first locking groove 88, the support bracket 53 does not rotate. Due to the elastic force of the elastic member 83, the recording head 51 rotates around the hinge hole 82 in a direction indicated by an arrow "D2", such that the recording head 51 elastically contacts the support member 52.

In this state, the conveying part 40 begins to convey the recording medium 10 toward the third path. The recoding head 51 prints magenta images, yellow images, or the like by applying heat upon the first side of the recording medium 10. The magenta color and yellow color can be selectively reproduced depending on temperature and heating time of the recording medium 51. For example, the magenta color can be reproduced under conditions of a high temperature and a short time, and the yellow color can be reproduced under conditions of a low temperature and a relatively long time. When the printing on the first side of the recording medium 10 is finished, the recording medium 10 is moved from the second path and positioned at the third path. The conveying part 40 stops conveying the recording medium 10.

Figure 5D:
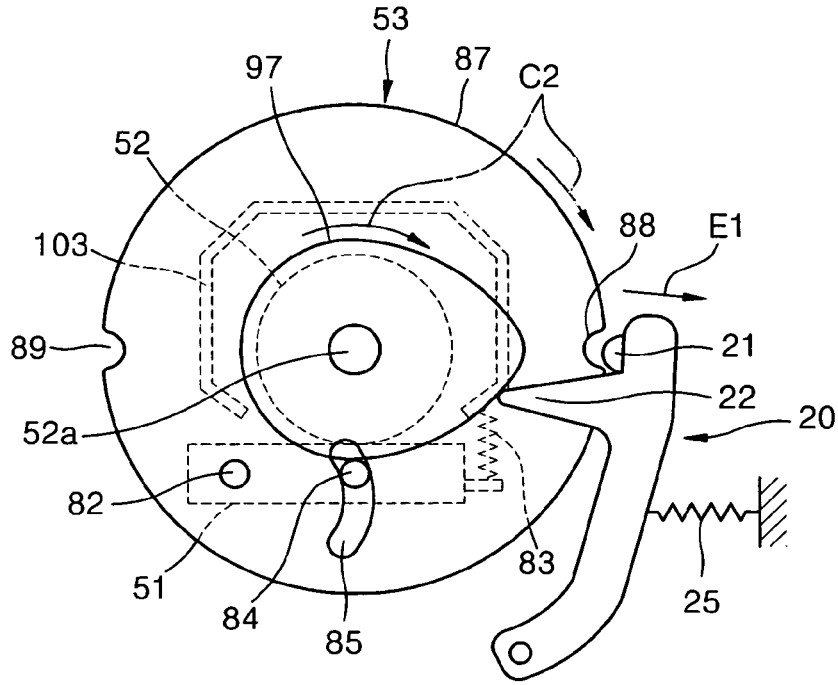
Figure 5E:
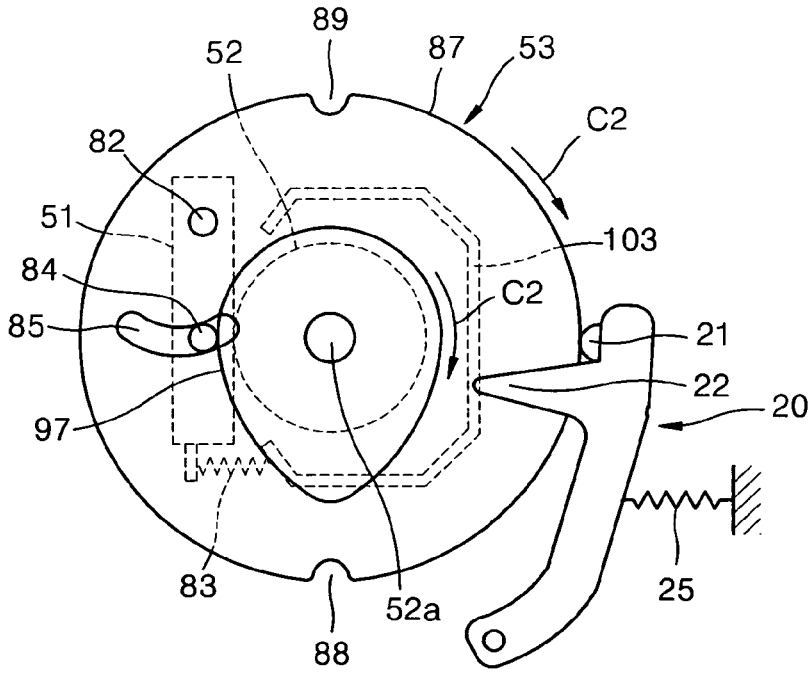

Then, an operation of moving the recording head 10 toward the second location is performed so as to print an image on the second side of the recording medium 10. Referring to FIG. 5D, the rotation cam 95 rotates in a direction indicated by an arrow "C2", and the cam 97 pushes the interference portion 22 such that the locking member 20 rotates in a direction indicated by an arrow "E1". Upon the rotation of the locking member 20, the protrusion 21 is released from the first locking groove 88, and the support bracket 53 is freed such that it becomes rotatable. Accordingly, when the cam 97 continuously rotates in a direction indicated by the arrow "C2," and thus pushes the shaft 84, the support bracket 53 rotates in a direction indicated by an arrow "C2", as shown in FIG. 5E, rather the recording head 51 be separated in a direction indicated by the arrow "D1". While the support bracket 53 is rotating in the direction indicated by an arrow "C2", the cam 97 pushes the shaft 84 such that the recording head 51 is slightly separated from the support member 52. When the contact between the cam 97 and the interference portion 22 is discontinued, the locking member 20 is kept in contact with the outer circumference 87 of the support bracket 53 by the elastic force of the elastic member 25.

Figure 5F:
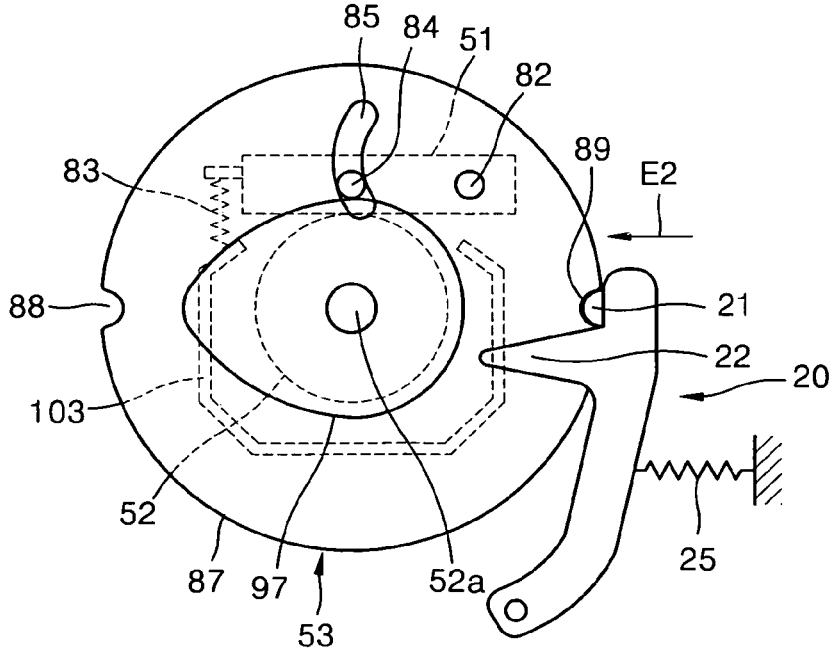

Referring to FIG. 5F, once the support bracket 53 rotates by approximately 180°, the elastic force of the elastic member 25 causes the locking member 20 to rotate in a direction indicated by an arrow "E2", such that the protrusion 21 is coupled to the second locking groove 89. Therefore, the support bracket 53 is then locked, and thus does not rotate. As shown in FIG. 3B, the recording head 51 reaches the second location facing the second side of the recording medium 10. The rotation guide 103 rotates together with the recording head 51 such that the second guide part 103*b* faces the conveying part 40.

Figure 5G:
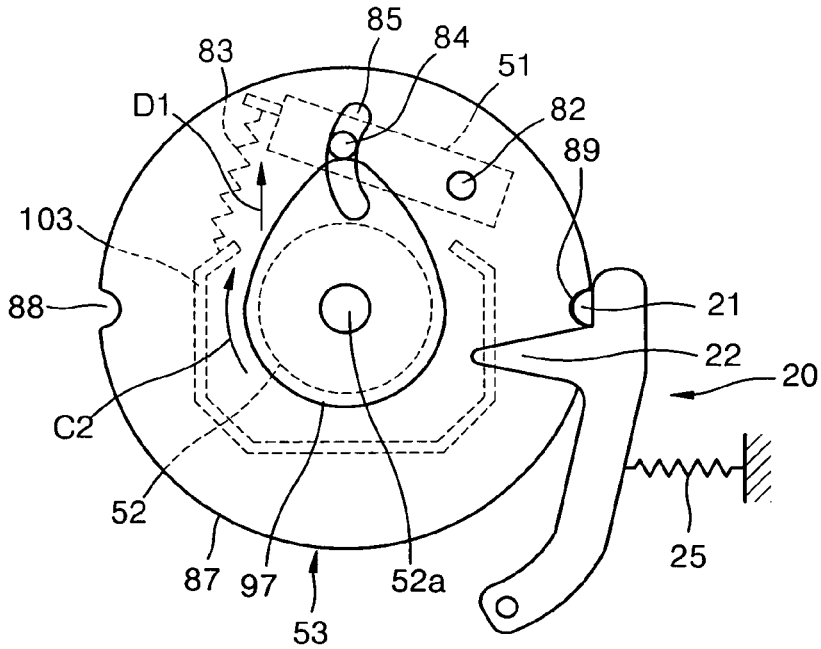

If the rotation cam 95 continues to rotate in a direction indicated by the arrow "C2", the support bracket 53 does not rotate because the protrusion 21 is coupled to the second locking groove 89. Referring to FIG. 5G, the shaft 84 is pushed along the through hole 85, and the recording head 51 is separated from the support member 52.

Figure 5H:
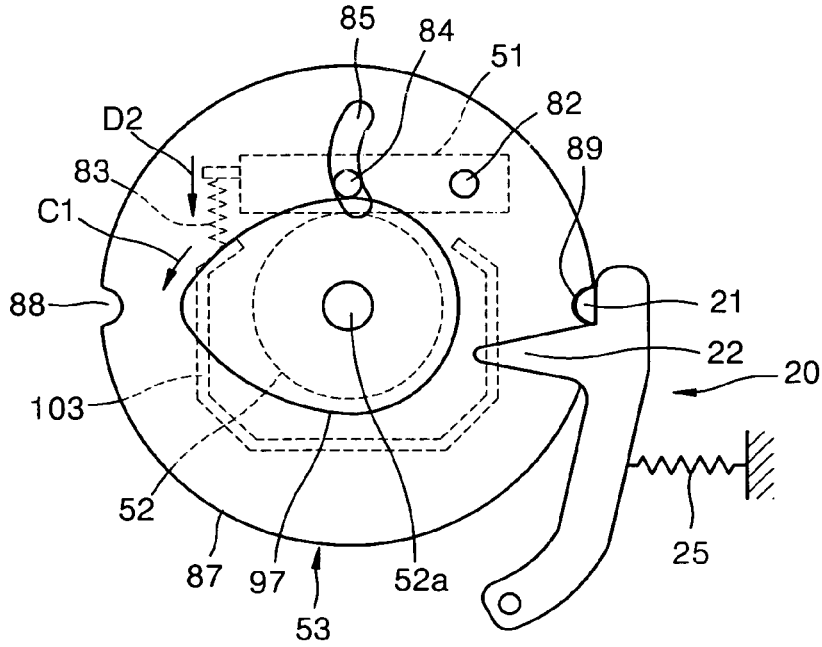

In this state, the conveying part 40 conveys the recording medium 10 from the third path to the second path. As shown in FIG. 3B, the recording medium 10 is guided to the gap between the recording head 51 and the support member 52 by the second guide part 103*b* of the rotation guide 103. When the recording medium 10 reaches the print start location, the conveying part 40 stops conveying the recording medium 10. If the rotation cam 95 rotates in the direction indicated by the arrow "C1", the support bracket 53 does not rotate because the protrusion 21 is locked to the second locking groove 89. Instead, the shaft 84 moves back along the through hole 85, and the recording head 51 comes into contact with the support member 52, as shown in FIG. 5H.

The conveying part 40 again conveys the recording medium 10 toward the third path. The recording head 51 prints images, such as cyan images, on the second side of the recording medium 10 by applying heat thereto. After the printing on the first and second sides is finished, the recording medium 10 is discharged out of the image forming apparatus by the discharge part 60.

Figure 5I:
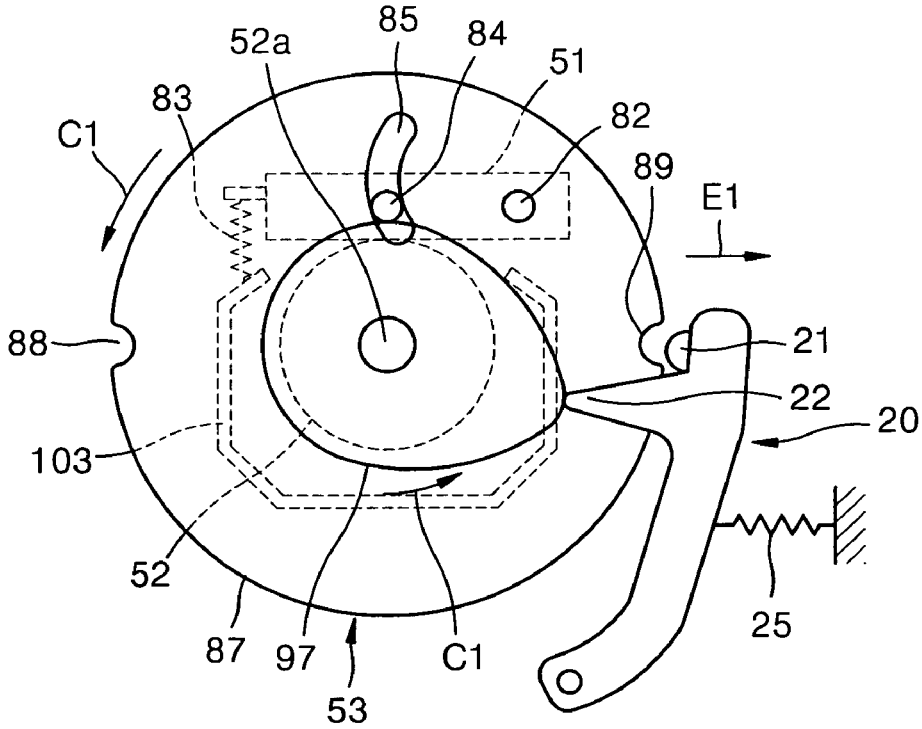

Referring to FIG. 5I, when the printing operation is completed, the rotation cam 95 rotates in a direction indicated by the arrow "C1". The cam 97 pushes the interference portion 22 such that the locking member 20 rotates in a direction indicated by the arrow "E1". In that state, the protrusion 21 is separated from the second locking groove 89, and the support bracket 53 is freely rotatable. If the cam 97 pushes the shaft 84, the support bracket 53 rotates until the protrusion 21 is locked into the first locking groove 88 by the elastic force of the elastic member 25. Upon the locking of the protrusion 21 in the first locking groove 88, as shown in FIG. 5A, the recording head 51 returns back to the first location. In this state, or as shown in FIG. 5B, the recording head 51 can be ready for the next printing operation, by being separated from the support member 52.

In such a structure, if the base sheet 11 of the recording medium 10 is formed of a transparent material, cyan, magenta and yellow images may be overlapped together to reproduce full color images. Also, if the base sheet 11 is formed of an opaque material, the double-sided printing is possible by forming different images on the first and second sides of the recording medium.

In order to form an image on both sides of the recording medium 10, the recording head 51 rotates around the shaft 52*a* of the support member 52. Also, the recording medium 10 reciprocates two times through an approximately straight path. Since the recording medium 10 is conveyed through a very simple path while an image is formed on both sides thereof, the probability that the recording medium 10 will be jammed is very low. Also, since the rotation guide 103 rotates together with the recording head 51, the recording medium 10 can be stably guided to the printing nip even when the position of the printing nip is changed.

Also, since the recording head 51 rotates around the support member, the conveying path of the recording medium is very simple. Thus, compared with the conventional printer, mechanical troubles seldom occur in the image forming apparatus, and the size of the printer can be scaled down.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A thermal image forming apparatus comprising:

a support member to support a recording medium, the recording medium having first and second sides opposite to each other;

a recording head, facing the support member, to form an image by heating the recording medium, wherein the recording head is rotatable around a shaft of the support member such that the recording head moves to first and second locations respectively facing the first and second sides of the recording medium;

a conveying part to convey the recording medium; and a rotation guide to rotate together with the recording head such that the recording medium is guided between the support member and the recording head.

2. The apparatus of claim 1, wherein the rotation guide comprises:

a first guide part positioned between the support member and the conveying part in response to the recording head being positioned at the first location, such that the recording medium is guided between the support member and the recording head; and a second guide part positioned between the support member and the conveying part in response to the recording head being positioned at the second location, such that the recording medium is guided between the support member and the recording head.

3. The apparatus of claim 2, wherein the first and second guide parts are symmetrical with respect to the support member.

4. The apparatus of claim 2, wherein the first and second guide parts are asymmetrical with respect to the support member.

5. The apparatus of claim 1, further comprising:

a pair of support brackets rotatably supported around a shaft of the support member, and coupled to the recording head and the rotation guide; and a motor rotating at least one of the support brackets.

6. The apparatus of claim 5, further comprising an elastic member having a first end coupled to the recording head and a second end coupled to the rotation guide, the elastic member elastically biasing the recording head in a direction to cause contact with the support member.

7. The apparatus of claim 1, further comprising:

a pair of support brackets rotatably supported around a shaft of the support member, and coupled to the recording head and the rotation guide;

a shaft having a first end coupled to the recording head and a second end inserted into a through hole formed in at least one of the support brackets;

a motor; and a rotation cam rotated by the motor, wherein the rotation cam moves the shaft coupled to the recording head to rotate the pair of support brackets.

8. The apparatus of claim 7, further comprising an elastic member having a first end coupled to the recording head and a second end coupled to the rotation guide, the elastic member elastically biasing the recording head in a direction to cause contact with the support member.

9. A thermal image forming apparatus comprising:

a recording head to form an image by heating a recording medium, the recording medium having first and second sides opposite to each other;

a support member, facing the recording head, to support the recording medium to form a printing nip;

a conveying part to convey the recording medium;

a pair of support brackets rotatably supported around a shaft of the support member, and coupled to the recording head;

a motor to rotate the support brackets such that the recording head is moved to first and second locations respectively facing the first and second sides of the recording medium; and a rotation guide coupled to the support brackets to guide the recording medium to the printing nip.

10. The apparatus of claim 9, wherein the rotation guide comprises:

a first guide part positioned between the support member and the conveying part in response to the recording head being positioned at the first location, such that the recording medium is guided between the support member and the recording head; and a second guide part positioned between the support member and the conveying part in response to the recording head being positioned at the second location, such that the recording medium is guided between the support member and the recording head.

11. A thermal image forming apparatus to form an image on a recording medium having first and second sides, the apparatus comprising:

a recording head to form the image by heating the recording medium, wherein the recording head rotates between first and second locations to respectively face the first and second sides of the recording medium;

a rotation guide to rotate along with the recording head to guide the recording medium to the recording head; and a support member to support the recording medium, wherein the recording head and rotation guide rotate around the support member between the first and second locations.

12. The apparatus of claim 11, wherein the rotation guide comprises a first guide part to guide the recording medium to the recording head in the first location; and a second guide part to guide the recording medium to the recording head in the second location.

13. The apparatus of claim 12, wherein the first and second guide parts are symmetrical around a central portion of the support member.

14. The apparatus of claim 11, further comprising an elastic member coupled to the recording head and the rotation guide to elastically bias the recording head in a direction to cause contact with the support member.

15. The apparatus of claim 11, further comprising at least one support bracket coupled to the recording head and rotation guide, wherein the support bracket rotates to move the recording head and rotation guide between the first and second locations.

16. The apparatus of claim 15, further comprising a locking member to lock the support bracket in each of the first and second locations.

17. The apparatus of claim 16, wherein the support bracket comprises at least one locking portion provided to interact with the locking member to lock the support bracket in each of the first and second locations.

18. The apparatus of claim 17, wherein the locking portion is a receiving portion to receive a protrusion provided on the locking member.

19. The apparatus of claim 16, further comprising a biasing member to bias the locking member in a direction toward the support bracket.

20. The apparatus of claim 16, further comprising a rotation cam to rotate and move the locking member out of a position in which the support bracket is locked.

21. The apparatus of claim 11, wherein the recording medium reciprocates twice through a substantially straight path to the recording head to form the image on each of the first and second opposite sides.

22. A thermal image forming apparatus to form images on a recording medium having first and second sides, the apparatus comprising:

a supporting member to support the recording medium;

a recording head to rotate around the supporting member to form the respective images on the first and second sides of the recording medium; and a rotation guide coupled so as to rotate along with the recording head to guide the recording medium between the supporting member and recording head;

wherein the recording medium reciprocates twice between the recording head and the supporting member without being inverted.

* * * * *